US005456034A

United States Patent [19]

Lewis et al.

[11] Patent Number: 5,456,034

[45] Date of Patent: Oct. 10, 1995

[54] CLIP-ON SCANNER HOOK LABEL HOLDER

[75] Inventors: Kirk Lewis, Lees Summit, Mo.; John Gebka, Coral Springs, Fla.

[73] Assignee: Femc Ltd., Ft. Lauderdale, Fla.

[21] Appl. No.: 213,632

[22] Filed: Mar. 16, 1994

[51] Int. Cl.[6] ..... G09F 3/16

[52] U.S. Cl. ..... 40/666; 40/661; 24/336

[58] Field of Search ..... 24/336, 563, 564, 24/555; 248/231.8, 221.4; 40/666, 661, 642, 663, 5

[56] References Cited

U.S. PATENT DOCUMENTS

| | | | |
|---|---|---|---|
| 1,213,644 | 1/1917 | Holcomb | 24/336 X |
| 2,524,922 | 10/1950 | Moburg | 24/336 X |
| 4,773,172 | 9/1988 | Fast | 248/221.4 X |
| 4,901,962 | 2/1990 | Greer | 24/564 X |
| 5,044,104 | 9/1991 | Hopperdietzel | 40/661 X |
| 5,263,269 | 11/1993 | Tjärnlund | 40/5 |

FOREIGN PATENT DOCUMENTS

| | | | |
|---|---|---|---|
| 1039096 | 10/1953 | France | 24/336 |
| WO91/05324 | 4/1991 | WIPO | 40/642 |
| WO93/10516 | 5/1993 | WIPO | 40/642 |

*Primary Examiner*—Kenneth J. Dorner
*Assistant Examiner*—Joanne Silbermann
*Attorney, Agent, or Firm*—Jacobson, Price, Holman & Stern

[57] ABSTRACT

An extruded plastic label holder is provided to clip onto a metal plate at the forward end of a scanner hook on which products are displayed. The holder has a pocket to receive a non-adhesive label in place of an adhesive label which would otherwise need to be used on the plate. The holder has a body panel and a clip element between which the plate is gripped and the clip element has a layer of flexible plastic to improve its grip.

8 Claims, 2 Drawing Sheets

CLIP-ON SCANNER HOOK LABEL HOLDER

BACKGROUND OF THE INVENTION

This invention relates to a clip-on label holder for a scanner hook.

So-called scanner hooks are metal hooks from which products are suspended for display in supermarkets and other stores. A scanner hook has parallel upper and lower elongate limbs with proximal and distal ends. The proximal ends generally merge into a mounting bracket, for example comprising a pair of spaced metal prongs for fitting in adjacent apertures of an apertured board whereby the hook is mounted on the board. The lower limb of the hook is used for suspending the products and its distal end commonly is bent upwardly somewhat. The upper limb of the hook projects over and commonly somewhat beyond the lower limb, and its distal end is bent down or to either side at a right angle and welded to a metal plate intended to receive an adhesive label providing information regarding products on the hook.

Adhesive labels tend to be somewhat more expensive, for example, than non-adhesive labels, and it is a primary object of the invention to provide a holder which can clip onto the metal plate of a scanner hook and which can receive a non-adhesive rather than an adhesive label.

Another object of the invention is to provide a label holder as described which will attach firmly and securely to the plate and not be easily displaced or dislodged, for example, when products are removed from the hook.

SUMMARY OF THE INVENTION

The invention provides a clip-on label holder for the purpose indicated in the form of a plastic extrusion having a planar main body panel with a top edge and a bottom edge. Extending upwardly from the bottom edge is a flat planar see-through cover parallel to the body panel and forming therebetween a pocket, open at the top, to receive a non-adhesive label. Extending rearwardly from the top edge of the body panel is a depending clip element or grip, which may be substantially S-shaped, so that the holder can be clipped onto the metal plate of a scanner hook from above and frictionally grip the plate between the main body panel and the clip element.

To enhance the frictional grip of the holder on the plate, a section of relatively softer or more flexible plastic may be co-extruded with a gripping portion of the holder preferably on a curve of the clip element. Thus, the holder generally is extruded in a relatively rigid or hard plastic, e.g. PVC, which tends to slide against a metal surface and the frictional grip of the holder on the plate is thus improved by the coextruded softer or more flexible gripping portion.

The cover may be transparent or somewhat opaque and may be the same material as the main body panel. Alternatively, the cover and main body panel may be of different materials coextruded along their bottom edges.

The clip element may be extended forwardly somewhat along the top edge of the holder to provide a projecting lip protecting the label-receiving pocket. Preferably, the holder is designed to be somewhat shorter than the plate of a scanner hook on which it is intended to be used so that, when attached, the bottom edge of the holder is above the bottom edge of the plate. This provides protection against the holder being bumped or dislodged by removal of products from the lower limb of the hook.

Additional features and advantages of the invention will be apparent from the ensuing description and claims read in conjunction with the attached drawings.

DESCRIPTION OF THE PREFERRED EMBODIMENT

Figure 1:
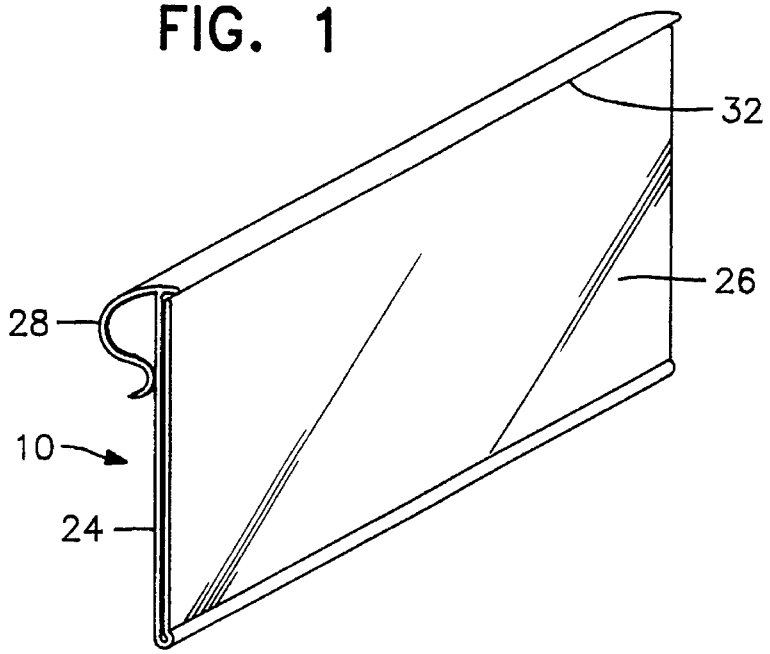
FIG. 1 is a perspective view of a clip-on label holder according to the invention.
Figure 2:
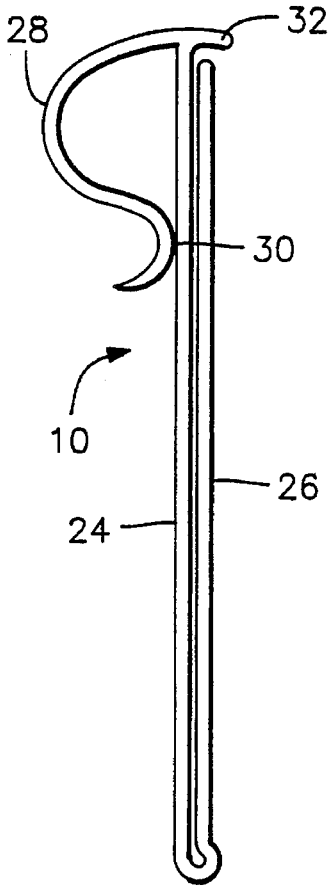
FIG. 2 is an end elevational view of the holder.

A clip-on label holder 10 according to the invention as intended for use on a metal scanner hook 12 used for suspending products for display in a supermarket or other store. Scanner hook 12 is of a well known type having parallel upper and lower elongate limbs 14, 16 which merge at their proximal ends into a two-prong mounting bracket 18 for attaching the hook to an apertured support board or the like. Lower limb 16 is intended for suspending the products and upper limb 14 extends forwardly somewhat beyond limb 16. The front or distal end of limb 14 has a downturned or sideturned leg 20 welded to a metal plate 22 for receiving labelling providing information regarding products on the hook. Label holder 10 clips onto plate 22 in accordance with the invention and can receive a non-adhesive label instead of an adhesive label which would otherwise need to be used on plate 22.

Label holder 10 is a plastic extrusion comprising a planar main body panel 24, a parallel see-through cover 26 and an S-shaped clip or grip element 28 extending rearwardly and downwardly from the top edge of the body panel. The cover 26 is integrally extruded with the body panel along the bottom edge of the holder and may be transparent or somewhat opaque. If the cover and body panel are to be of different plastic materials they are coextruded along the bottom edge. The body panel and cover define a narrow top-opening pocket therebetween to receive a non-adhesive label.

Figure 3:
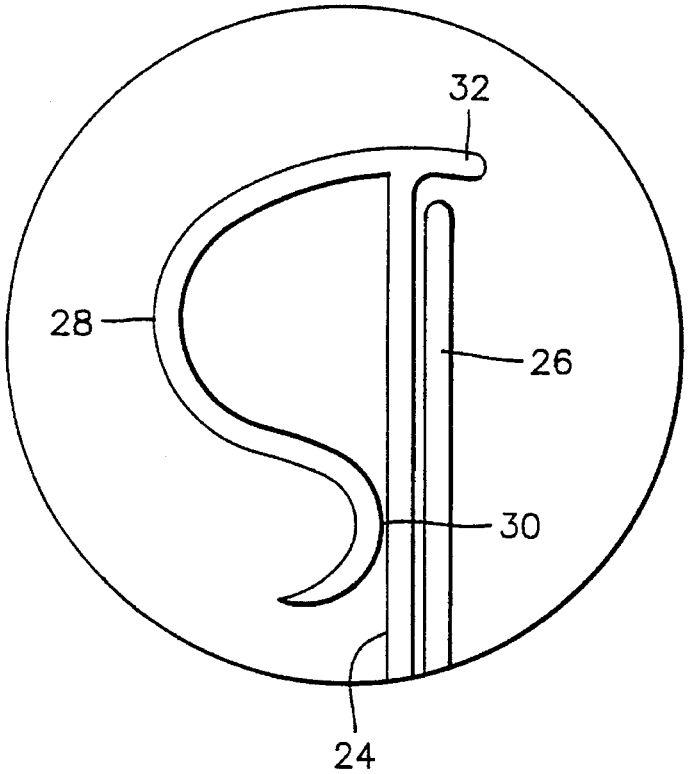
FIG. 3 is an enlarged end elevational view of a top part of the holder.

The holder 10 is formed generally of a relatively hard or rigid plastic such as PVC. The S-shaped clip element 28, however, includes a curved gripping section facing the body panel which is covered with a coextruded layer of softer or flexible plastic 30 (FIG. 3) to improve the frictional grip of the holder against plate 22.

The holder may, for example, be extruded from any conventional PVC referred to commercially as "rigid" such as Occidental Chemical Corporation's OXYCLEAR 161J/161J-1 or Georgia Gulf's Extrusion Compound 8247 or 7020. The layer 30 may be coextruded from a "flexible" PVC such as Teknor Apex Company's 3165 compound or Synergistic's clear compound 0750. These commercially available PVC extrusion compounds are illustrative of available compounds which can be used. Further, while PVC is a preferred material for the holder and for layer 30, those skilled in the art can readily substitute alternative rigid and flexible polymers.

Along its top edge, body panel 24 is provided with a forwardly projecting lip 32 to protect the pocket and label inserted therein.

Figure 4:
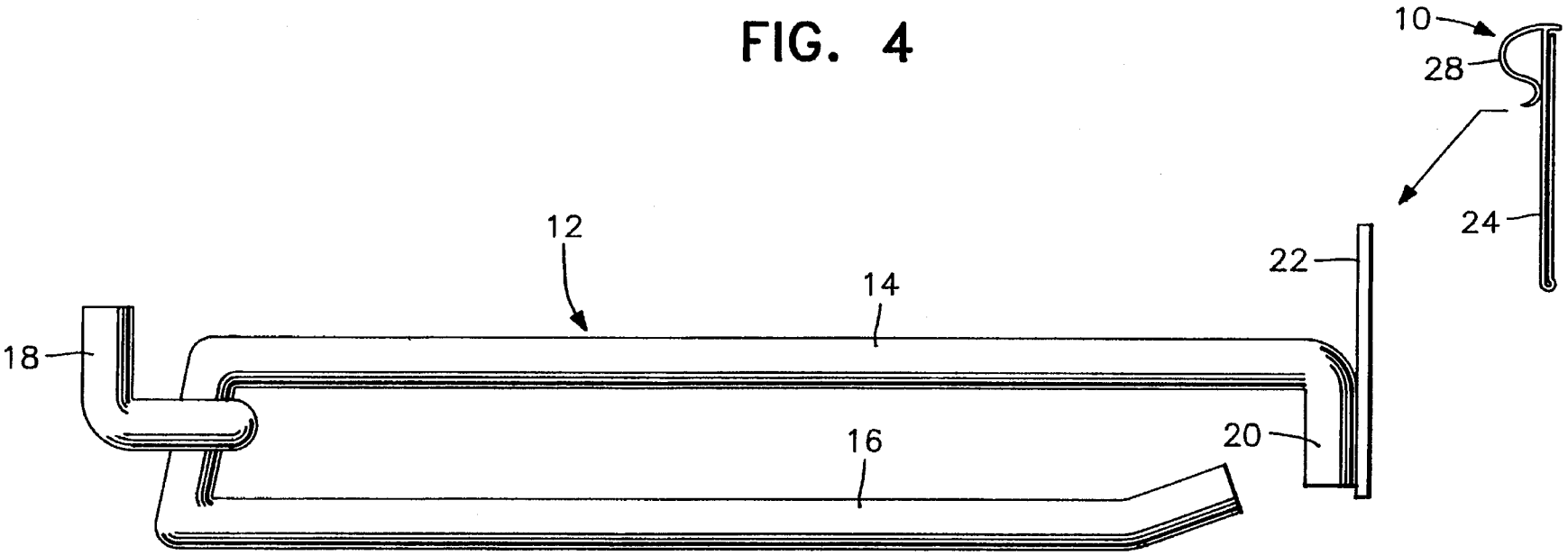
FIG. 4 is a side elevational view of a scanner hook showing the manner of attachment of the clip-on holder.
Figure 5:
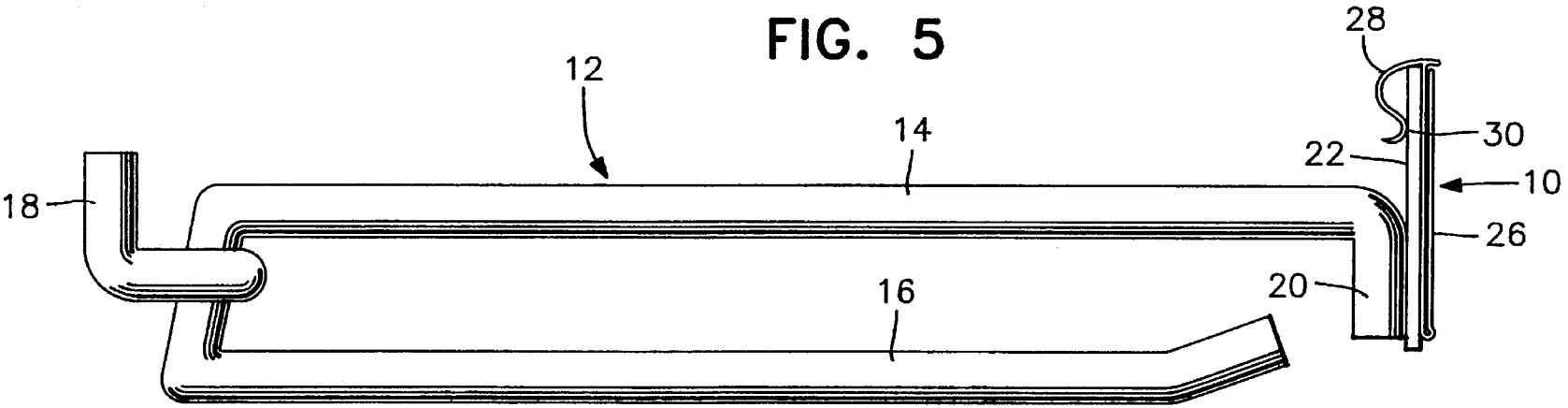
FIG. 5 is a view similar to FIG. 4 showing the holder attached to the hook.

In use, as shown in FIG. 4, holder 10 is clipped onto plate 22 from above and the plate is frictionally gripped between panel 24 and the flexible layer 30 on grip 28. Also, as seen in FIG. 5, the height of holder 10 is preferably somewhat less than that of plate 22 so that when attached, the bottom edge of the holder is above the bottom edge of the plate thus providing protection against the holder being knocked out of position by withdrawal of products from limb 16 of the hook.

A label holder according to the invention includes a number of additional advantageous features. By attaching only to the top of plate 22, the holder avoids interference with leg 20 and its weld. The holder provides a pressurized pocket, by the use of body panel 24 and cover 26, which is better suited to hold onto a label not only when mistreated but also in relocation of the label holder itself. By clipping the label holder only at the top of plate 22, when a product is removed from a hook above (should such be present) the attachment of the label holder tends to be enhanced as the product drags across its top. The flexible PVC layer 30 at the pressure point of clip 28 creates frictional contact of the holder on plate 22 tending to avoid inherent sliding encountered when rigid plastic is adjacent to metal. The frictional contact reduces the possibility of removal of the label holder by sliding from side to side.

While only a preferred embodiment of the invention has been described herein in detail, the invention is not limited thereby and modifications are possible within the scope of the attached claims.

What is claimed is:

1. A label holder for clipping onto a plate at a proximal end of a scanner hook to provide labelling of products displayed on the hook, the label holder comprising an extrusion of a relatively rigid plastic material with a planar body panel having a top edge and a bottom edge, a planar see-through cover extending upwardly from the bottom edge in front of said panel and defining a top-opening label pocket between the panel and cover and a clip element extending rearwardly and downward from the body panel for clipping the holder onto the plate from above, the clip element having a gripping surface comprising a coextrusion on said clip said coextrusion comprising a plastic material softer than said relatively rigid plastic material, said coextrusion facing the body panel for providing a frictional grip against the plate.

2. A holder as claimed in claim 1, wherein the clip element is substantially S-shaped and the gripping surface comprises a curved portion of the clip element facing the body panel.

3. A holder as claimed in claim 2, wherein said coextrusion is provided only on said curved portion of the clip element.

4. A holder as claimed in claim 3, wherein the cover is formed as a coextrusion with the body panel.

5. A holder as claimed in claim 1, wherein the clip element extends from the top edge of the body panel and wherein the top edge further includes a forwardly extending lip protecting said pocket.

6. A plastic label holder for clipping onto a plate at a proximal end of a scanner hook to provide labelling of products displayed on the hook, the label holder comprising a planar body panel having a top edge and a bottom edge, a planar see-through cover extending upwardly from the bottom edge in front of said panel and defining a top-opening label pocket between the panel and cover and a clip element extending rearwardly and downward from the body panel for clipping the holder onto the plate from above, the clip element having a gripping surface facing the body panel for providing a frictional grip against the plate; and a scanner hook having a metal plate at a forward end thereof on which the holder is to be mounted wherein the holder has a height dimension less than a corresponding height dimension of the plate.

7. A holder as claimed in claim 6, wherein the holder is clipped onto plate with said bottom edge of the holder being located above a corresponding bottom edge of the plate.

8. A plastic label holder for clipping onto a plate at a proximal end of a scanner hook to provide labelling of products displayed on the hook, the label holder comprising a planar body panel having a top edge and a bottom edge, a planar see-through cover extending upwardly from the bottom edge in front of said panel and defining a top-opening label pocket between the panel and cover and a clip element extending rearwardly and downward from the body panel for clipping the holder onto the plate from above, the clip element having a gripping surface facing the body .panel for providing a frictional grip against the plate; wherein the body panel and clip element are made of a relatively rigid plastic material and wherein at least one of the body panel and the gripping surface includes a layer of a relatively flexible plastic material to enhance its frictional grip against the plate;

wherein the clip element is substantially S-shaped and the gripping surface comprises a curved portion of the clip element facing the body panel;

wherein said holder comprises a plastic extrusion and said layer of relatively flexible plastic is formed on said curved portion as a coextrusion; and a scanner hook having a forward end provided with a metal plate on which the holder is to be mounted wherein the holder has a height dimension which is less than a corresponding height dimension of the plate.

* * * * *